US012109447B2

(12) United States Patent
Schell

(10) Patent No.: US 12,109,447 B2
(45) Date of Patent: Oct. 8, 2024

(54) COLLAPSIBLE JUGGLING CLUB

(71) Applicant: Schell Games LLC, Pittsburgh, PA (US)

(72) Inventor: Jesse Schell, Pittsburgh, PA (US)

(73) Assignee: Schell Games LLC, Pittsburgh, PA (US)

( * ) Notice: Subject to any disclaimer, the term of this patent is extended or adjusted under 35 U.S.C. 154(b) by 241 days.

(21) Appl. No.: 18/052,137

(22) Filed: Nov. 2, 2022

(65) Prior Publication Data

US 2023/0134547 A1 May 4, 2023

Related U.S. Application Data

(60) Provisional application No. 63/275,747, filed on Nov. 4, 2021.

(51) Int. Cl.
*A63B 15/02* (2006.01)
*A63B 67/08* (2019.01)

(52) U.S. Cl.
CPC ..... *A63B 15/02* (2013.01); *A63B 67/086* (2013.01); *A63B 2209/08* (2013.01); *A63B 2210/50* (2013.01); *A63B 2225/74* (2020.08)

(58) Field of Classification Search
CPC ..... A63B 15/00; A63B 15/02; A63B 15/005
See application file for complete search history.

(56) References Cited

U.S. PATENT DOCUMENTS

| | | | | |
|---|---|---|---|---|
| 4,135,719 | A * | 1/1979 | Braunhut | F41B 15/00 463/47.7 |
| 5,356,139 | A * | 10/1994 | Parsons | F41B 15/025 463/47.7 |
| 5,873,783 | A * | 2/1999 | McBain | F41B 15/025 463/47.7 |
| 9,182,192 | B2 * | 11/2015 | Quail | F41B 15/025 |
| D861,814 | S * | 10/2019 | Laverty | D21/780 |
| 2004/0132590 | A1 * | 7/2004 | Papas | A63B 23/12 482/109 |
| 2008/0248891 | A1 * | 10/2008 | Nelson | A63B 69/3623 473/229 |

* cited by examiner

*Primary Examiner* — Zachary T Moore
(74) *Attorney, Agent, or Firm* — K&L Gates LLP

(57) ABSTRACT

A collapsible juggling club is disclosed herein. The collapsible juggling club can include an end portion, a plurality of intermediate portions, and a handle portion. The end portion defines a cavity and includes a first diameter. The handle portion includes a second diameter that is less than the first diameter of the end portion. The plurality of intermediate portions include descending diameters and are arranged telescopically between the end portion and the handle portion, such that the juggling club can telescopically transition between a collapsed condition, wherein each intermediate portion of the plurality is nested with the cavity defined by the end portion, and an extended condition, wherein the end portion, each intermediate portion of the plurality, and the handle portion are secured to an adjacent portion via a friction fit.

17 Claims, 5 Drawing Sheets

COLLAPSIBLE JUGGLING CLUB

CROSS-REFERENCE TO RELATED APPLICATION

This application claims benefit under 35 U.S.C. § 119(e) to U.S. Provisional Application No. 63/275,747, filed Nov. 4, 2022 entitled "COLLAPSIBLE JUGGLING CLUB," the entire disclosure of which is hereby incorporated by reference herein.

BACKGROUND

Most professional performers inevitably have to travel. Indeed, many performers work hard to increase their reach and will eventually schedule regional, national, and international tours to perform for new audiences. Many acts, however, require equipment that might not be appropriate for easy and/or economic traveling. For example, many jugglers incorporate juggling clubs into their act, but juggling clubs are not necessarily conducive to efficient packing. This is because juggling clubs are designed with standard characteristics, including standard lengths, weights, and centers of gravity. Although such characteristics promote familiarity for the juggler and thus, consistency performance, such characteristics also render conventional juggling clubs awkward and inconvenient to pack in a backpack or carry-on suitcase. Accordingly, there is a need for collapsible juggling clubs that, when collapsed, have a streamlined form factor and, when extended, comply with juggling club standards.

SUMMARY

In various aspects of the present disclosure, a collapsible juggling club is disclosed. The collapsible juggling club can include an end portion defining a cavity including a cross-sectional shape with a first dimension, a handle portion including the cross-sectional shape with a second dimension that is less than the first dimension, and a plurality of intermediate portions disposed between the end portion and the handle portion. Each of the intermediate portions includes the same cross-sectional shape (e.g., a circle) as the handle and end portion, but with a different cross-sectional dimension that is less than the first dimension and greater than the second dimension. The end portion, the handle portion, and the plurality of intermediate portions are arranged such that the juggling club is telescopically transitionable between (1) a collapsed condition, in which each intermediate portion of the plurality is nested substantially within the cavity of the end portion, and (2) a fully extended condition, in which the end portion, the plurality of intermediate portions, and the handle portion are arranged linearly and secured to an adjacent portion via a friction fit. Further, in the fully extended condition, the collapsible juggling club includes a length that is greater than or equal to seventeen inches and less than or equal to twenty two inches, a weight that is greater than or equal to seven ounces and less than or equal to eleven ounces, and a center of mass that is located at approximately sixty percent the length of the collapsible juggling in the fully extended condition towards the end portion. That way, in the fully extended condition, the collapsible juggling club closely approximates the length, weight and weight distribution of a standard juggling club. Yet in the collapsed condition, the collapsible juggling club can be easily transported or carried, such as in luggage, in a pocket, in a backpack, etc.

In various aspects of the present disclosure, the collapsible juggling can include first weight configured to define the center of mass of the collapsible juggling club.

FIGURES

Various embodiments are described herein by way of example in connection with the following figures.

DESCRIPTION

Figure 1:
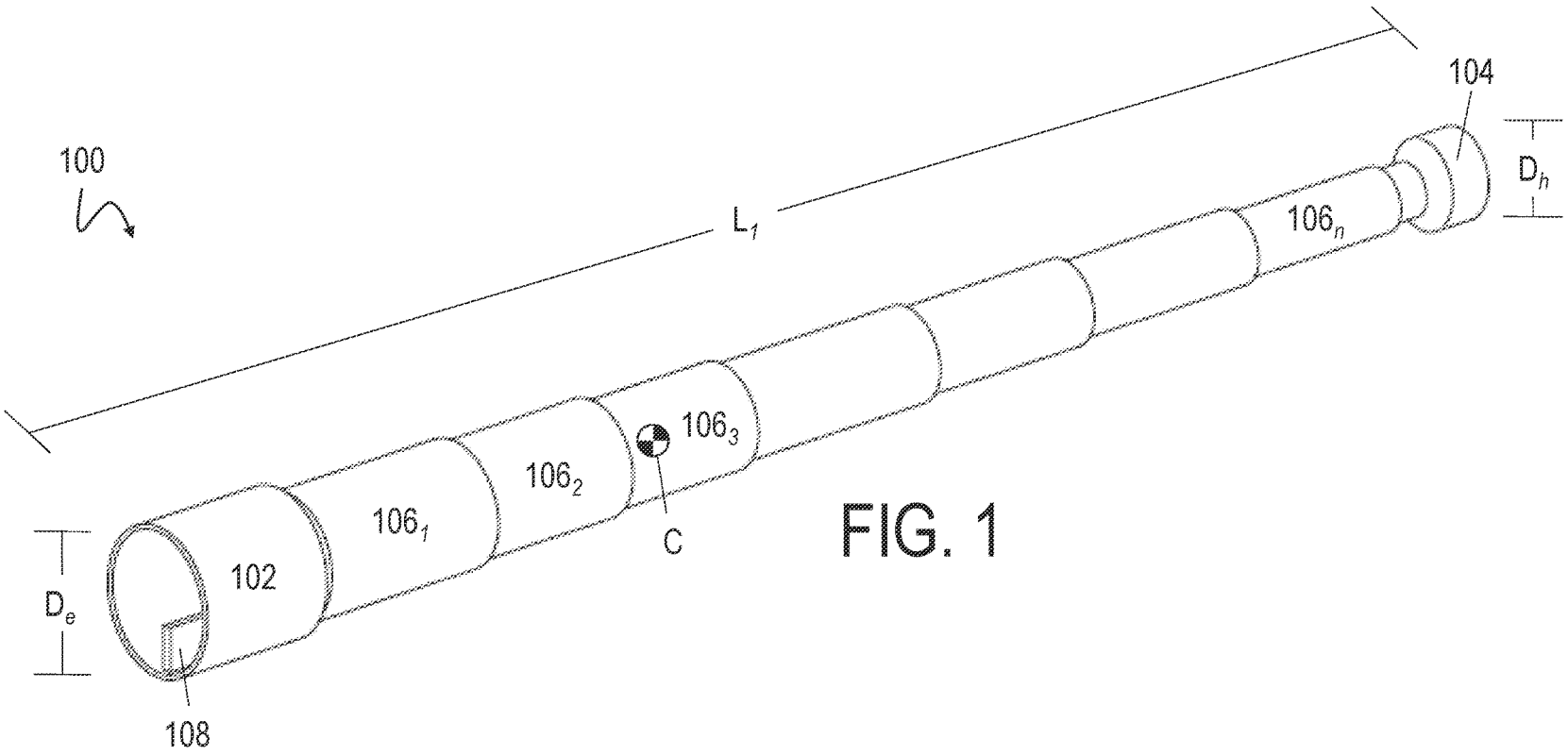
FIG. 1 illustrates a perspective view of a collapsible juggling club according to at least one non-limiting aspect of the present disclosure.

Referring now to FIG. 1, a perspective view of a collapsible juggling club is depicted in accordance with at least one non-limiting aspect of the present disclosure. According to the non-limiting aspect of FIG. 1, the collapsible juggling club 100 can include an end portion 102, a plurality of intermediate, telescoping portions $\mathbf{106}_{1-n}$, and a handle portion 104. In the illustrated embodiment, the handle, end and intermediate portions are cylindrical in shape with a circular cross section. The juggling club 100 can be dimensionally configured such that a diameter $D_e$ of the end portion 102 is larger than a diameter $D_h$ of the handle portion 104 and, when fully extended, the juggling club 100 can be dimensionally configured to define a desired length $L_1$. A first weight 108 can be coupled (e.g., glued, screwed, nailed, or integrally formed with, etc.) to the end portion 102. The first weight 108 can be configured relative to the mass of the rest of the juggling club 100 such that the juggling club 100 is desirably balanced about a center of mass C that is intermediate the length L1 of the juggling club when extended. According to some non-limiting aspects, a second weight can be coupled (e.g., glued, screwed, nailed, or integrally formed with, etc.) to the handle portion 104. For example, according to the non-limiting aspect of FIG. 1, the first weight 108 can be positioned within the end portion 102 and coupled to an interior surface of the end portion 102. Although the non-limiting aspect of FIG. 1 depicts a rectangular weight 108 positioned on an inner wall of the end portion 102, it shall be appreciated that, according to other non-limiting aspects, the first weight 108 or the weight positioned within the handle portion 104 can be alternately configured according to user preference. For example, according to some non-limiting aspects, the weight 108 can be geometrically configured and positioned within the end portion 102 and/or handle portion 104 to preferably balance the juggling club 100. According to such aspects, the weight 108 can be cylindrically configured and positioned flush against a surface of the end portion 102 and/or the handle portion 104. This can prevent the juggling club 100 from wobbling as it rotates. According to some non-limiting aspects, the handle portion 104 can be alternately configured to include various features that promote a desired grip, including tape, rubber, and/or texture, amongst others. Also, there are preferably seven intermediate portions 106 (e.g., n=7).

According to the non-limiting aspect of FIG. 1, each intermediate portion $\mathbf{106}_{1\text{-}n}$ of the plurality of intermediate portions $\mathbf{106}_{1\text{-}n}$ can be similarly configured, e.g., cylindrically with a circular cross-sectional, such that a diameter (e.g., a cross-sectional dimension) of each intermediate portion $\mathbf{106}_{1\text{-}n}$ that is positioned towards the end portion 102 of the juggling club 100 is larger than a diameter of each intermediate portion $\mathbf{106}_{1\text{-}n}$ that is positioned towards the handle portion 104 of the juggling club 100. That is, each intermediate portion $\mathbf{106}_a$ has a greater diameter than its immediate adjacent intermediate portion $\mathbf{106}_{n+1}$, from end portion 102 to handle portion 104, when the juggling club is fully extended, such that each intermediate portion 106*n*+1 is sized to fit within the immediate adjacent intermediate portion 106 toward the end portion 102 when the juggling club 100 is collapsed into a travel size. Moreover, the diameter of a first intermediate portion $\mathbf{106}_1$ that is positioned towards the handle portion 104 of the juggling club 100 is larger than the diameter of a second, adjacent, intermediate portion 1062 that is positioned towards the end portion 102 of the juggling club 100. Additionally, each of the plurality of intermediate portions $\mathbf{106}_{1\text{-}n}$, is hollow and thus, defines an internal cavity. Also, the end portion 102 and the handle portion may be cylindrical. Also, the end portion 102 can be hollow.

In further reference to FIG. 1, as alluded to above, the plurality of intermediate portions $\mathbf{106}_{1\text{-}n}$, can be telescopically configured. For example, the second intermediate portion $\mathbf{106}_2$ can be nested within the cavity defined by the first intermediate portion $\mathbf{106}_1$ because the diameter of the first intermediate portion $\mathbf{106}_1$ (e.g., closer to the handle portion 104) is larger than the adjacent diameter of the second intermediate portion $\mathbf{106}_2$ (e.g., closer to the end portion 102). Accordingly, the juggling club 100 of FIG. 1 can, in essence, collapse within itself, which makes it selectively compact and thus, ideal for traveling. The collapsible nature of the juggling club 100 is further illustrated and described in reference to FIG. 3.

Although the collapsible nature of the juggling club 100 of FIG. 1 makes it ideal for traveling, the juggling club 100, when extended, the juggling club 100 is also seamlessly functional and geometrically familiar to the juggler. Most jugglers will recognize that familiarity of feel, balance, and weight of their clubs is essential, as even slight differences in a club's dimensions, weight, and/or weight allocation can be disruptive to their act. Accordingly, most juggling clubs are manufactured to certain standards. For example, a typical juggling club has a length of approximately 20 inches, a weight between 7 and 11 ounces, and is balanced such that it has a center of mass approximately 60% down the length of the club towards the end portion or, in other words, the portion with the greater diameter. As such, the extended length $L_1$ of the juggling club 100, when fully extended can be 17 to 22 inches in length, and preferably 20 inches in length, and the combined weight of the juggling club (including the first weight 108 coupled to the end portion 102, a second weight in the handle portion 104, the handle portion 104, the end portion 102, and the intermediate portions) is preferably between 7 and 11 ounces. Furthermore, the first weight 108 coupled to the end portion 102 can be configured relative to mass of the rest of the juggling club 100—and according to some non-limiting aspects, a second weight (not shown) coupled to the handle portion 104 of the juggling club—such that the center of mass C of the juggling club 100 is positioned between 55% and 65%, and preferably approximately 60%, of the length L of the juggling club towards the end portion 102 (that is, closer to the end portion 102 than to the handle portion 104 when the juggling club is fully extended). Of course, the juggling club 100 can be alternately configured to include any desirable length, diameters, weight, and/or center of mass, depending on user preference and/or intended application.

Figure 2:
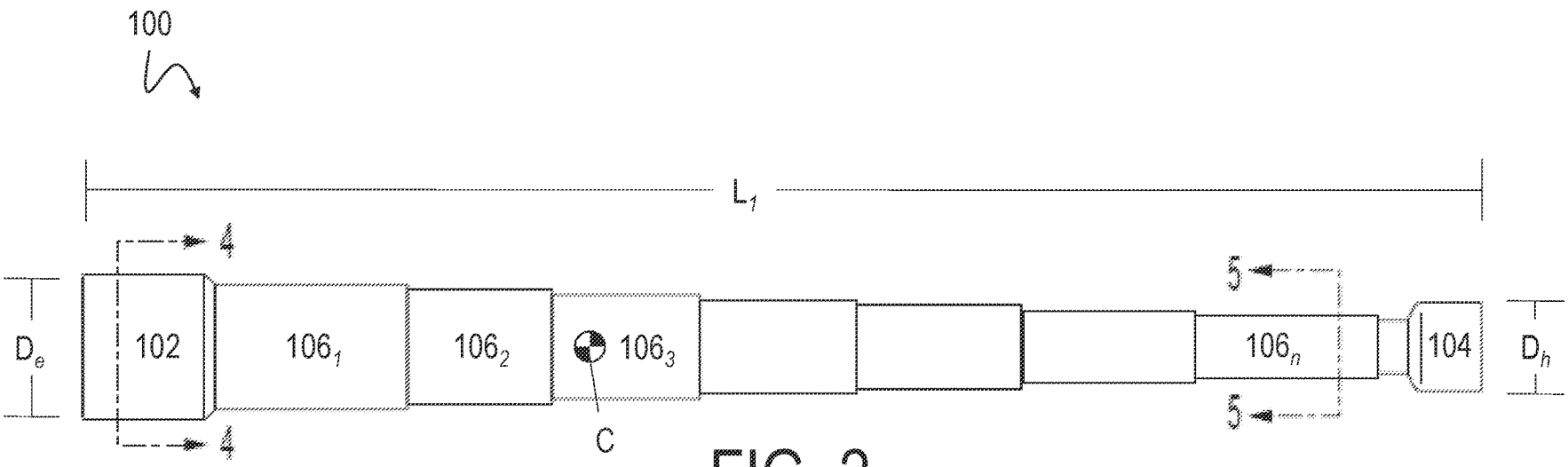
FIG. 2 illustrates a side view of the collapsible juggling club of FIG. 1 in an extended condition.

Referring now to FIG. 2, a side view of the collapsible juggling club 100 of FIG. 1 is depicted in an extended condition, in accordance with at least one non-limiting aspect of the present disclosure. According to the non-limiting aspect of FIG. 2, the telescoping nature of the plurality of intermediate portions $\mathbf{106}_{1\text{-}n}$ is illustrated thus, giving the collapsible juggling club 100 a tapered configuration when viewed from the side. That is, the handle portion 104 is narrower than the end portion 102. Furthermore, FIG. 2 illustrates how the end portion 102 can be integrally formed with the first intermediate portion $\mathbf{106}_1$. Alternately, according to other non-limiting aspects, the end portion 102 can be separately formed and mechanically coupled to the first intermediate portion $\mathbf{106}_1$. For example, the end portion 102 can merely be a cap configured for attachment to the first intermediate portion $\mathbf{106}_1$. According to still other non-limiting aspects, the first intermediate portion $\mathbf{106}_1$ can be configured to function in lieu of the end portion 102. In other words, the first intermediate portion $\mathbf{106}_1$ can be sealed at one end and/or configured to accommodate the weight 108 (FIG. 1) that would otherwise be positioned within the end portion 102.

Still referring to FIG. 2, the handle portion 104 is depicted with a knob-like configuration, which can facilitate a better grip of the juggling club 100. According to the non-limiting aspect of FIG. 2, the knob can have a diameter $D_h$ that is less that the diameter $D_e$ of the end portion 102, but greater than a diameter of an adjacent intermediate portion $\mathbf{106}_n$ that is positioned closer to the handle portion 104 of the juggling club 100. Thus, diameter $D_h$ can prevent the handle portion 104 of the juggling club 100 from slipping through the juggler's hand while in use. Of course, according to non-limiting aspects where the handle portion 104 of the juggling club 100 includes alternate grips (e.g., tape, rubber, texture, etc.), a knob-like configuration, such as depicted in FIG. 2, may not be necessary.

Furthermore, FIG. 2 illustrates how the handle portion 104 can be integrally formed with the adjacent intermediate portion $\mathbf{106}_n$. Alternately, according to other non-limiting aspects, the handle portion 104 can be separately formed and mechanically coupled to the adjacent intermediate portion $\mathbf{106}_n$. For example, the handle portion 104 can merely be a knob-shaped cap configured for attachment to the adjacent intermediate portion $\mathbf{106}_n$. According to still other non-limiting aspects, the last intermediate portion $\mathbf{106}_n$ can be configured to function in lieu of the handle portion 104 and thus, may utilize grips in lieu of the knob-like configuration of FIG. 2. In other words, the first intermediate portion 106*i* can be sealed at one end and/or configured to accommodate the weight (not shown) that would otherwise be positioned within the handle portion 104. Additionally, the adjacent diameters of each intermediate portion $\mathbf{106}_{1\text{-}n}$ of the plurality can be dimensionally configured such that, when extended, a friction fit between each intermediate portion $\mathbf{106}_{1\text{-}n}$ of the plurality is created. Thus, when extended, the friction between intermediate portions $106_{1-n}$ of the plurality will prevent the collapsible juggling club 100 from inadvertently collapsing.

Figure 3:
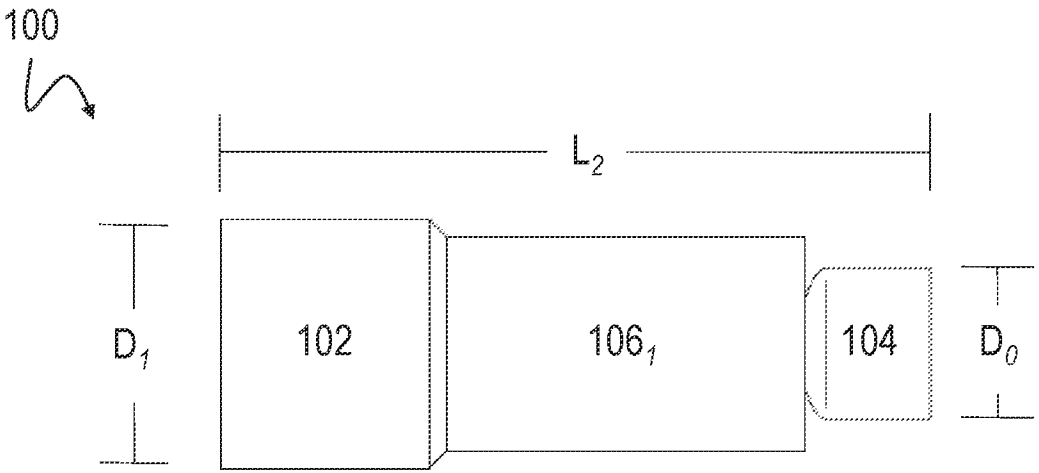
FIG. 3 illustrates a side view of the collapsible juggling club of FIG. 1 in a collapsed condition.

Referring now to FIG. 3, a side view of the collapsible juggling club 100 of FIG. 1 is depicted in an collapsed condition, in accordance with at least one non-limiting aspect of the present disclosure. According to the non-limiting aspect of FIG. 3, when collapsed, the juggling club 100 can define a second length $L_2$, which is substantially smaller than the first length $L_1$ (FIG. 2) defined by the juggling club 100 in the extended condition. The second length $L_2$ can be particular configured depending on exactly how compact the user desires the juggling club 100 to be when collapsed. However, in such aspects, more intermediate portions $106_{1-n}$ would be required to achieve the same extended length $L_1$ (FIG. 1). As such, the number of intermediate portions $106_{1-n}$, the collapsed length $L_2$, and the extended length $L_1$ (FIG. 2), and/or the weight of the juggling club 100 can be attenuated and/or optimized according to user preference.

Figure 4:
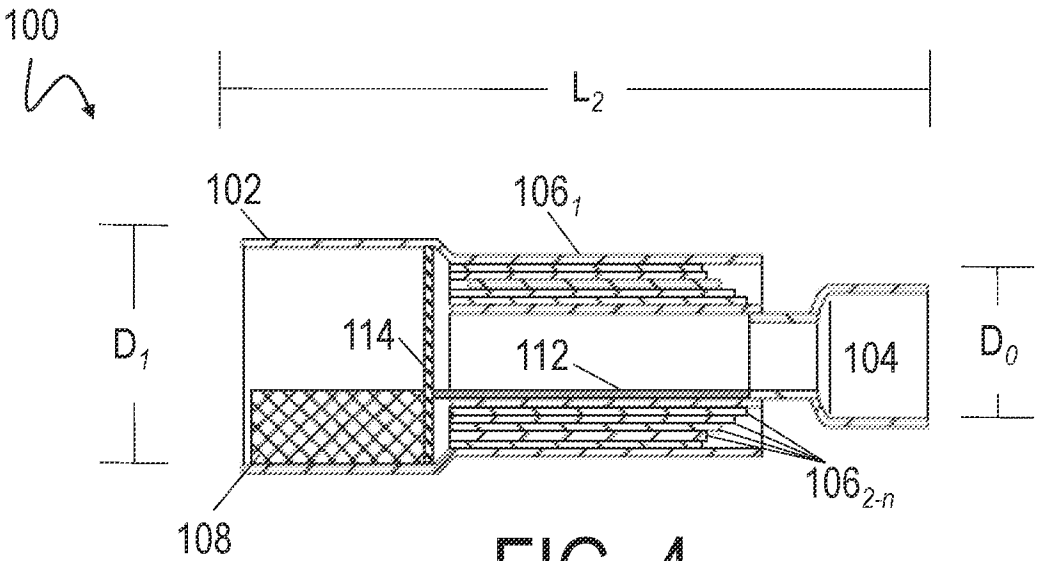
FIG. 4, illustrates a sectioned-side view of the collapsible juggling club of FIG. 3 in a collapsed condition, in accordance with at least one non-limiting aspect of the present disclosure.

Referring now to FIG. 4, a sectioned-side view of the collapsible juggling club 100 of FIG. 1 is depicted in a collapsed condition, in accordance with at least one non-limiting aspect of the present disclosure. According to the non-limiting aspect of FIG. 4, the telescoping nature of the collapsible juggling club 100 is illustrated. Specifically, each of the intermediate portions $106_{1-n}$ are nested within a cavity of an adjacent intermediate portion $106_{1-n}$. Notably, each intermediate portion $106_{2-n}$ of the plurality is nested within the cavity defined by the first intermediate portion $106_1$, which is integrally formed with the end portion 102 of the juggling club 102. Furthermore, the weight 108 positioned within the end portion 102 is evident. The weight 108 can be specifically configured relative to the mass of the juggling club 100 such that the juggling club 100 is desirably balanced about a center of mass C (FIG. 2) that is approximately 60% down the length towards the end portion 102. According to other non-limiting aspects, a second weight can be coupled to the handle portion 104 and configured relative to the first weigh 108 to achieve a desired center of mass.

In further reference to FIG. 4, a portion 112 of the handle portion 104 of the collapsible juggling club 100 can be magnetically configured to be attracted to a portion 114 of the end portion 104 of the collapsible juggling club 100. Accordingly, when collapsed, the portion 112 of the handle portion 104 will be attracted and magnetically attached to the portion 114 of the end portion 102, such that the collapsible juggling club 100 will not be inadvertently extended during travel. According to still other non-limiting aspects, the weight 108 in the end portion 102 of the juggling club 100 can be magnetically attracted to the portion 112 in the handle portion 104 and thus, used in lieu of the portion 114 of FIG. 4 to prevent the juggling club 100 from being inadvertently extended during travel. Similar to the weight 108, it shall be appreciated that, according to other non-limiting aspects, the magnet portion 112 can be alternately configured and/or located. For example, according to other non-limiting aspects, the magnet portion 112 can double as a weight positioned in the handle portion 112 and thus, can be cylindrically configured and positioned flush against a surface of the handle portion 112 to desirably balance the juggling club 100.

Although the weight 108 and the magnetically attracted portions 112, 114 of the handle portion 104 and end portion 102 of FIG. 4 are depicted in a particular position with particular geometric configurations, it shall be appreciated that they can be alternately configured to achieve a similar result (e.g., balancing the club 100, magnetically attaching the end portion 102 to the handle portion 104). For example, according to some non-limiting aspects, a cap attached to the end portion 102 can be a particularly weighted piece of metal and thus, can serve in lieu of the weight 108 and the second portion 114 of FIG. 4. Such a metallic cap can attract the magnetic portion 112 in the handle portion 104 of the juggling club 100 and also achieve a desired center of mass. In other words, the particular components of the juggling club 100 of FIG. 4 can be consolidated and/or alternately configured depending on user preference.

Figure 5:
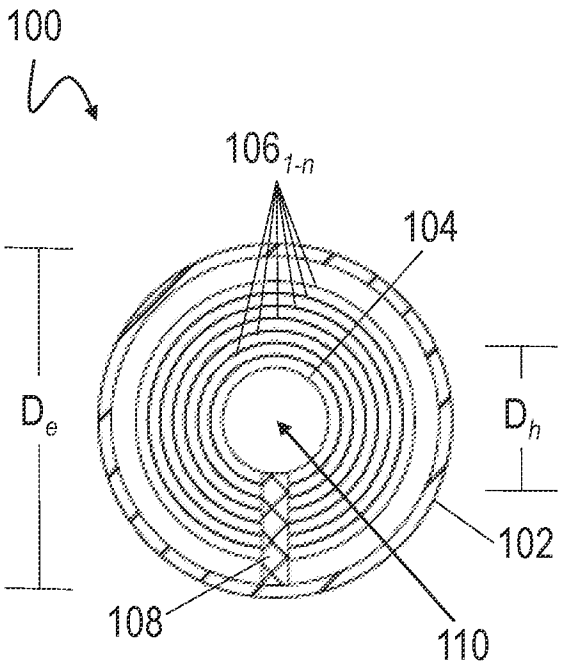
FIG. 5 illustrates a cross-sectioned view of the juggling club of FIG. 2 taken along line 4, in accordance with at least one non-limiting aspect of the present disclosure.

Referring now to FIG. 5 a cross-sectioned view of the juggling club 100 of FIG. 2 taken along line 4 is depicted in accordance with at least one non-limiting aspect of the present disclosure. According to the non-limiting aspect of FIG. 5, the diameter $D_e$ of the end portion 102 is depicted relative to the diameter $D_h$ of the handle portion 104. The relative diameters of each of the intermediate portions $106_{1-n}$ are also depicted. It is evident from FIG. 5 that the diameter $D_e$ of the end portion 102 is the largest, and that the diameter of an intermediate portion $106_1$ adjacent, or integral to, the end portion 102 is the second largest, and so on, through to the diameter $D_h$ of the handle portion 104, which is the smallest of the juggling club 100 assembly.

As previously discussed, the weight 108 that, according to the non-limiting aspect of FIG. 5, is coupled within a cavity defined by the end portion 102 of the juggling club 100, can be metallic and thus, configured for magnetic attachment to a magnetically configured portion 112 (FIG. 6) of the handle portion 104. However, according to other non-limiting aspects other components of the end portion 102 can be configured for magnetic attachment to a magnetically configured portion 112 of the handle portion 104. For example, the end portion 102 can include a metallic cap or surface 110 at its end, which can be positioned such that it is attracted to the magnetically configured portion 112 of the handle portion 104. Alternatively, according to other non-limiting aspects, a metallic screw or bolt can be used to secure another component (e.g., a plastic or rubber cap) to the end portion 102 of the juggling club 100. As such, the magnetically configured portion 112 (FIG. 6) of the handle portion 104 can be magnetically attracted to the metallic screw or bolt. Regardless, each of the end portion 102 and the handle portion 104 can include magnetically configured components that attract and this, keep the handle portion 104 secured to the end portion 102 when the juggling club 100 is in a collapsed condition and prevent inadvertent extension.

Figure 6:
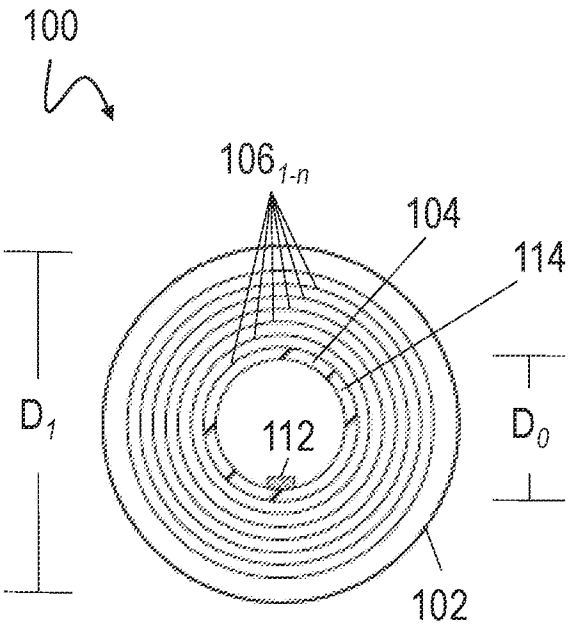
FIG. 6 illustrates a cross-sectioned view of the juggling club of FIG. 2 taken along line 5, in accordance with at least one non-limiting aspect of the present disclosure.

Referring now to FIG. 6 a cross-sectioned view of the juggling club 100 of FIG. 2 taken along line 5 is depicted in accordance with at least one non-limiting aspect of the present disclosure. According to the non-limiting aspect of FIG. 6, the diameter $D_h$ of the handle portion 104 is depicted relative to the diameter $D_e$ of the end portion 102. The relative diameters of each of the intermediate portions $106_{1-n}$ are also depicted. It is evident from FIG. 6 that the diameter $D_h$ of the handle portion 104 is the smallest, and that the diameter of an intermediate portion $106_n$ adjacent, or integral to, the handle portion 104 is the second smallest, and so on, through to the diameter $D_e$ of the end portion 102, which is the largest of the juggling club 100 assembly.

As previously discussed, the handle portion 104 can include a magnetic portion 112 that, according to the non-limiting aspect of FIG. 6, is coupled within a cavity defined by the handle portion 104 of the juggling club 100. Since the weight 108 (FIG. 5) can be metallic the magnetic portion 112 can be configured for magnetic attachment to the weight 108 (FIG. 5) in the end portion 102. However, according to other non-limiting aspects other components of the handle portion 104 can be configured for magnetic attachment to any magnetic or metallic portion of the end portion 102. For example, the handle portion 104 can include a magnetic surface 114 configured to interface with a metallic and/or magnetic surface 110 (FIG. 5) of the end portion 102. As such, the magnetically configured surface 114 of the handle portion 104 can be magnetically attracted to any metallic and/or magnetic surface 110 (FIG. 5) of the end portion 102. Regardless, each of the end portion 102 and the handle portion 104 can include magnetically configured components that attract and this, keep the handle portion 104 secured to the end portion 102 when the juggling club 100 is in a collapsed condition and prevent inadvertent extension.

Although the cross-sectional area defined by the juggling club 100 of FIGS. 5 and 6 is circular, it shall be appreciate that, according to other non-limiting aspects, the juggling club 100 can define cross-sectional areas of varying geometries. For example, according to some non-limiting aspects, the juggling club 100 can be alternately configured to include a triangular, rectangular, and/or hexagonal cross-section, amongst other shapes. Additionally, according to other non-limiting aspects, each of the intermediate portions $106_{1-n}$ can be tapered, having a cross-sectional dimension that descends along a length of the of the intermediate portion $106_{1-n}$, such that the juggling club 100 has a taper beyond the inherent taper that results from telescoping nature of the of the intermediate portions $106_{1-n}$. In other words, according to such aspects, the juggling club 100 can have a tapered cylindrical configuration.

According to some non-limiting aspects, the juggling club 100 can include a power source and one or more lights (e.g., light emitting diodes, halogen, incandescent, etc.) in either the end portion 102 or the handle portion 104, such that the juggling club 100 can be used at night or in otherwise dark areas. Likewise, in some non-limiting aspects, any of the end portion 102, the intermediate portions $106_{1-n}$, and/or the handle portion 104 can be colored such that the juggling club 100 has a certain aesthetic effect. For example, the handle portion 104 and/or one or more intermediate portions $106_{1-n}$ closer to the handle portion 104 can be colored a darker color than the end portion 102 and/or one or more intermediate portions $106_{1-n}$ closer to the end portion 102. This can create the effect of a conventional juggling club, which generally have darker colored handles. According to other non-limiting aspects, one or more portions 102, 104, $106_{1-n}$ of the juggling club 100 can have different colors or alternating colors, creating a rainbow effect or "zebra" effect, respectively. Of course, according to other non-limiting aspects, one or more portions 102, 104, $106_{1-n}$ of the juggling club 100 can have a pattern printed on them for a desired aesthetic effect.

The examples presented herein are intended to illustrate potential and specific implementations of the present invention. It can be appreciated that the examples are intended primarily for purposes of illustration of the invention for those skilled in the art. No particular aspect or aspects of the examples are necessarily intended to limit the scope of the present invention. Further, it is to be understood that the figures and descriptions of the present invention have been simplified to illustrate elements that are relevant for a clear understanding of the present invention, while eliminating, for purposes of clarity, other elements. While various embodiments have been described herein, it should be apparent that various modifications, alterations, and adaptations to those embodiments may occur to persons skilled in the art with attainment of at least some of the advantages. The disclosed embodiments are therefore intended to include all such modifications, alterations, and adaptations without departing from the scope of the embodiments as set forth herein.

Various aspects of the subject matter described herein are set out in the following numbered clauses:

Clause 1: A collapsible juggling club, including: an end portion defining a cavity including a cross-sectional shape with a first dimension; a handle portion including the cross-sectional shape with a second dimension that is less than the first dimension; and a plurality of intermediate portions disposed between the end portion and the handle portion, wherein: each of the plurality of intermediate portions includes the cross-sectional shape with a different cross-sectional dimension that is less than the first dimension and greater than the second dimension; the end portion, the handle portion, and the plurality of intermediate portions are arranged such that the juggling club is telescopically transitionable between a collapsed condition, wherein each intermediate portion of the plurality is nested substantially within the cavity of the end portion, and a fully extended condition, wherein the end portion, the plurality of intermediate portions, and the handle portion are arranged linearly and secured to an adjacent portion via a friction fit; and in the fully extended condition, the collapsible juggling club includes a length that is greater than or equal to seventeen inches and less than or equal to twenty two inches, a weight that is greater than or equal to seven ounces and less than or equal to eleven ounces, and a center of mass that is located at approximately sixty percent the length of the collapsible juggling in the fully extended condition towards the end portion.

Clause 2: The collapsible juggling club according to clause 1, further including a first weight coupled to the end portion.

Clause 3. The collapsible juggling club according to either clause 1 or 2, further including a second weight coupled to the handle portion.

Clause 4. The collapsible juggling club according to any of clauses 1-3, further including at least one magnet coupled to at least one of the end portion or the handle portion, and wherein the handle portion and end portion are configured to be magnetically secured when the collapsible juggling club is in the collapsed condition.

Clause 5. The collapsible juggling club according to any of clauses 1-4, wherein the cross-sectional shape is a cylinder, and wherein the first dimension and the second dimension are diameters.

Clause 6. The collapsible juggling club according to any of clauses 1-5, wherein the cross-sectional shape includes a triangle, a rectangle, or a hexagon.

Clause 7. The collapsible juggling club according to any of clauses 1-6, wherein the handle portion includes a grip.

Clause 8. The collapsible juggling club according to any of clauses 1-7, wherein the grip includes at least one of a tape, a rubber, and a texture, or combinations thereof.

Clause 9. The collapsible juggling club according to any of clauses 1-8, wherein the plurality of intermediate portions includes seven intermediate portions.

Clause 10. The collapsible juggling club according to any of clauses 1-9, further including a power source and a light electrically coupled to the power source.

Clause 11. The collapsible juggling club according to any of clauses 1-10, wherein the light includes a light emitting diode, a halogen light, or an incandescent light.

Clause 12. The collapsible juggling club according to any of clauses 1-11, wherein each of the plurality of intermediate portions includes a length, and wherein each length of the plurality of intermediate portions is substantially the same.

Clause 13. The collapsible juggling club according to any of clauses 1-12, wherein, in the collapsed condition, the handle portion is nested substantially within the cavity of the end portion.

Clause 14. A collapsible juggling club, including: an end portion defining a cavity including a cross-sectional shape with a first dimension; a first weight coupled to the end portion, wherein the first weight is configured to define a center of mass of the collapsible juggling club; a handle portion including the cross-sectional shape with a second dimension that is less than the first dimension; and a plurality of intermediate portions disposed between the end portion and the handle portion, wherein: each of the plurality of intermediate portions includes the cross-sectional shape with a different cross-sectional dimension that is less than the first dimension and greater than the second dimension; the end portion, the handle portion, and the plurality of intermediate portions are arranged such that the juggling club is telescopically transitionable between a collapsed condition, wherein each intermediate portion of the plurality is nested substantially within the cavity of the end portion, and a fully extended condition, wherein the end portion, the plurality of intermediate portions, and the handle portion are arranged linearly and secured to an adjacent portion via a friction fit; and in the fully extended condition, the collapsible juggling club includes a length that is greater than or equal to seventeen inches and less than or equal to twenty two inches, a weight that is greater than or equal to seven ounces and less than or equal to eleven ounces.

Clause 15. The collapsible juggling club according to clause 14, further including a second weight coupled to the handle portion, wherein the second weight is configured to balance the collapsible juggling club about the center of mass relative to the first weight.

Clause 16. The collapsible juggling club according to either of clauses 14 or 15, wherein the center of mass is located at approximately sixty percent the length of the collapsible juggling in the fully extended condition towards the end portion.

Clause 17. The collapsible juggling club according to any of clauses 14-16, wherein the handle portion includes a grip.

Clause 18. The collapsible juggling club according to any of clauses 14-17, wherein the grip includes at least one of a tape, a rubber, and a texture, or combinations thereof.

Clause 19. The collapsible juggling club according to any of clauses 14-18, further including a power source and a light electrically coupled to the power source.

Clause 20. A collapsible juggling club, including: an end portion defining a cavity including a cross-sectional shape with a first dimension; a handle portion including the cross-sectional shape with a second dimension that is less than the first dimension; and a plurality of intermediate portions disposed between the end portion and the handle portion, wherein: each of the plurality of intermediate portions includes the cross-sectional shape with a different cross-sectional dimension that is less than the first dimension and greater than the second dimension; the end portion, the handle portion, and the plurality of intermediate portions are arranged such that the juggling club is telescopically transitionable between a collapsed condition, wherein each intermediate portion of the plurality is nested substantially within the cavity of the end portion, and a fully extended condition, wherein the end portion, the plurality of intermediate portions, and the handle portion are arranged linearly and secured to an adjacent portion via a friction fit; and in the fully extended condition, the collapsible juggling club includes a length that is greater than or equal to seventeen inches and less than or equal to twenty two inches, a weight that is greater than or equal to seven ounces and less than or equal to eleven ounces.

What is claimed is:

1. A collapsible juggling club, comprising:

an end portion defining a cavity comprising a cross-sectional shape with a first dimension;

a first weight coupled to the end portion, wherein the first weight is configured to define a center of mass of the collapsible juggling club;

a handle portion comprising the cross-sectional shape with a second dimension that is less than the first dimension;

a second weight coupled to the handle portion, wherein the second weight is configured to balance the collapsible juggling club about the center of mass relative to the first weight; and a plurality of intermediate portions disposed between the end portion and the handle portion, wherein:

each of the plurality of intermediate portions comprises the cross-sectional shape with a different cross-sectional dimension that is less than the first dimension and greater than the second dimension;

the end portion, the handle portion, and the plurality of intermediate portions are arranged such that the juggling club is telescopically transitionable between a collapsed condition, wherein each intermediate portion of the plurality is nested substantially within the cavity of the end portion, and a fully extended condition, wherein the end portion, the plurality of intermediate portions, and the handle portion are arranged linearly and secured to an adjacent portion via a friction fit; and in the fully extended condition, the collapsible juggling club comprises a length that is greater than or equal to seventeen inches and less than or equal to twenty two inches, a weight that is greater than or equal to seven ounces and less than or equal to eleven ounces, and a center of mass that is located at approximately sixty percent the length of the collapsible juggling in the fully extended condition towards the end portion.

2. The collapsible juggling club of claim 1, further comprising at least one magnet coupled to at least one of the end portion or the handle portion, and wherein the handle portion and end portion are configured to be magnetically secured when the collapsible juggling club is in the collapsed condition.

3. The collapsible juggling club of claim 1, wherein the cross-sectional shape is a cylinder, and wherein the first dimension and the second dimension are diameters.

4. The collapsible juggling club of claim 1, wherein the cross-sectional shape comprises a triangle, a rectangle, or a hexagon.

5. The collapsible juggling club of claim 1, wherein the handle portion comprises a grip.

6. The collapsible juggling club of claim 5, wherein the grip comprises at least one of a tape, a rubber, and a texture, or combinations thereof.

7. The collapsible juggling club of claim 1, wherein the plurality of intermediate portions comprises seven intermediate portions.

8. The collapsible juggling club of claim 1, further comprising a power source and a light electrically coupled to the power source.

9. The collapsible juggling club of claim 8, wherein the light comprises a light emitting diode, a halogen light, or an incandescent light.

10. The collapsible juggling club of claim 1, wherein each of the plurality of intermediate portions comprises a length, and wherein each length of the plurality of intermediate portions is substantially the same.

11. The collapsible juggling club of claim 1, wherein, in the collapsed condition, the handle portion is nested substantially within the cavity of the end portion.

12. A collapsible juggling club, comprising:

an end portion defining a cavity comprising a cross-sectional shape with a first dimension;

a first weight coupled to the end portion, wherein the first weight is configured to define a center of mass of the collapsible juggling club;

a handle portion comprising the cross-sectional shape with a second dimension that is less than the first dimension;

a second weight coupled to the handle portion, wherein the second weight is configured to balance the collapsible juggling club about the center of mass relative to the first weight; and a plurality of intermediate portions disposed between the end portion and the handle portion, wherein:

each of the plurality of intermediate portions comprises the cross-sectional shape with a different cross-sectional dimension that is less than the first dimension and greater than the second dimension;

the end portion, the handle portion, and the plurality of intermediate portions are arranged such that the juggling club is telescopically transitionable between a collapsed condition, wherein each intermediate portion of the plurality is nested substantially within the cavity of the end portion, and a fully extended condition, wherein the end portion, the plurality of intermediate portions, and the handle portion are arranged linearly and secured to an adjacent portion via a friction fit; and in the fully extended condition, the collapsible juggling club comprises a length that is greater than or equal to seventeen inches and less than or equal to twenty two inches, a weight that is greater than or equal to seven ounces and less than or equal to eleven ounces.

13. The collapsible juggling club of claim 12, wherein the handle portion is a different color than the end portion.

14. The collapsible juggling club of claim 12, wherein the handle portion comprises a grip.

15. The collapsible juggling club of claim 14, wherein the grip comprises at least one of a tape, a rubber, and a texture, or combinations thereof.

16. The collapsible juggling club of claim 12, further comprising a power source and a light electrically coupled to the power source.

17. A collapsible juggling club, comprising:

an end portion defining a cavity comprising a cross-sectional shape with a first dimension;

a first metallic weight coupled to the end portion, wherein the first metallic weight is configured to define a center of mass of the collapsible juggling club;

a handle portion comprising the cross-sectional shape with a second dimension that is less than the first dimension;

a second metallic weight coupled to the handle portion, wherein the second metallic weight is configured to balance the collapsible juggling club about the center of mass relative to the first metallic weight; and a plurality of intermediate portions disposed between the end portion and the handle portion, wherein:

each of the plurality of intermediate portions comprises the cross-sectional shape with a different cross-sectional dimension that is less than the first dimension and greater than the second dimension;

the end portion, the handle portion, and the plurality of intermediate portions are arranged such that the juggling club is telescopically transitionable between a collapsed condition, wherein each intermediate portion of the plurality is nested substantially within the cavity of the end portion, and a fully extended condition, wherein the end portion, the plurality of intermediate portions, and the handle portion are arranged linearly and secured to an adjacent portion via a friction fit; and in the fully extended condition, the collapsible juggling club comprises a length that is greater than or equal to seventeen inches and less than or equal to twenty two inches, a weight that is greater than or equal to seven ounces and less than or equal to eleven ounces.

* * * * *